US006696102B2

(12) United States Patent
Ray

(10) Patent No.: US 6,696,102 B2
(45) Date of Patent: Feb. 24, 2004

(54) CELLULOSE PRESERVATIVE METHOD AND APPARATUS

(75) Inventor: James N. Ray, Milton, FL (US)

(73) Assignee: Premier Wood Treating, L.L.C., Valdosta, GA (US)

( * ) Notice: Subject to any disclaimer, the term of this patent is extended or adjusted under 35 U.S.C. 154(b) by 201 days.

(21) Appl. No.: 09/766,385

(22) Filed: Jan. 19, 2001

(65) Prior Publication Data

US 2002/0098286 A1 Jul. 25, 2002

(51) Int. Cl.[7] ..... B05D 3/12; B05D 7/06

(52) U.S. Cl. ..... 427/298; 427/297; 427/325; 427/345; 427/351; 427/369; 427/392; 427/393

(58) Field of Search ..... 427/297, 298, 427/296, 369, 392, 393, 345, 325, 351

(56) References Cited

U.S. PATENT DOCUMENTS

| | | | | |
|---|---|---|---|---|
| 3,874,908 A | | 4/1975 | Liddell | |
| 4,668,539 A | * | 5/1987 | Leonard et al. | 427/298 |
| 4,670,992 A | * | 6/1987 | Leonard et al. | 34/350 |
| 5,395,656 A | * | 3/1995 | Liang | 427/297 |
| 5,478,598 A | | 12/1995 | Shidzawa | 427/297 |
| 5,652,023 A | | 7/1997 | Bergervoet et al. | |
| 6,040,057 A | | 3/2000 | Slimak et al. | 428/453 |
| 6,235,346 B1 | * | 5/2001 | Barnisin, Jr. | 427/297 |
| 6,235,403 B1 | * | 5/2001 | Vinden et al. | 427/297 |
| 6,274,199 B1 | * | 8/2001 | Preston et al. | 427/297 |

FOREIGN PATENT DOCUMENTS

| | | | |
|---|---|---|---|
| DE | 197 46 701 A1 | 4/1998 | |
| GB | 990834 | 5/1965 | |
| WO | WO 88/00114 | 1/1988 | |
| WO | WO 98/18872 | 5/1998 | |
| WO | WO98/18872 | 5/1998 | ..... C09D/15/00 |

* cited by examiner

*Primary Examiner*—Shrive P. Beck
*Assistant Examiner*—Kristen Crockford Jolley
(74) *Attorney, Agent, or Firm*—John P. Sinnott; Langdale & Vallotton, LLP

(57) ABSTRACT

A method and apparatus for applying a fluid preservative to wood or wood products has a work tank for maintaining a predetermined concentration of preservative in the fluid. The work tank is equipped with a heater to keep the temperature of the fluid and the preservative in the work tank at a predetermined level. Hot fluid and preservative is drawn under a vacuum, initially from the work tank. On filling a pressure vessel, a pressure pump then supplies the preservative and fluid mixture under pressure to the pressure vessel in which the wood or wood product is being treated. As the treatment process depletes the preservative in the fluid, through absorption in the wood, the depleted fluid is circulated back to the work tank where it is heated and more preservative is added to restore the concentration of preservative in the fluid to a desired level. The fluid, replenished with preservative, is then pumped into the pressure vessel. In this way a more uniform distribution of preservative in a desired concentration is achieved in the treated wood or wood product.

3 Claims, 1 Drawing Sheet

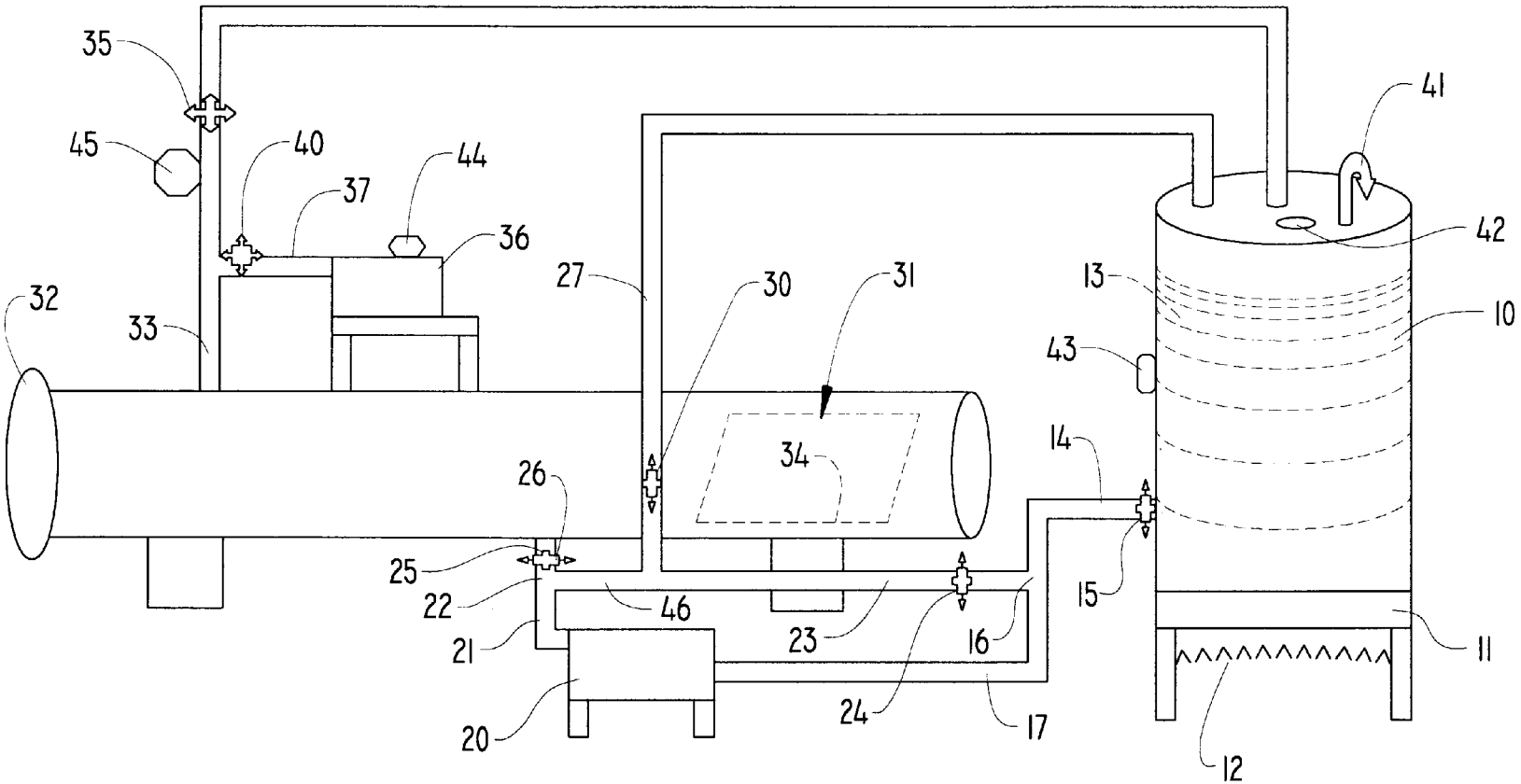
41
42
10
11
12
13
43
14
15
16
17
24
23
31
34
30
46
27
26
36
44
37
40
35
45
33
32
25
22
21
20

CELLULOSE PRESERVATIVE METHOD AND APPARATUS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

FIELD OF THE INVENTION

This invention is directed to methods and apparatus for treating cellulose materials with preservatives, and more particularly methods and apparatus for heating and replenishing a preservative compound during treatment of cellulose materials in order to better distribute and concentrate the preservative within the cellulose materials and the like.

BACKGROUND OF THE INVENTION

The need to treat cellulose materials, such as wood and wood products with preservatives and fire retardants is a very old need that continues to remain unsatisfied. For example, for centuries, a preservative to protect the hulls of wooden ships from damage and possible destruction through marine borers-the Teredo worm-was sought through copper sheathing of the hulls' wetted surfaces or through application of various preservative paints, all with greater or lesser effectiveness. Until recently, it had been customary to protect wood and wood products (e.g. chip board, plywood, railroad ties, dock pilings and the like) from exposure through creosote treatment. Creosote treatment was a reasonably satisfactory preservative, but its use is being discontinued because the environmental effects of creosote are unacceptable.

Accordingly, a need still exists for an economical and environmentally acceptable wood and wood product preservative and fire retardant treatment process. Toward this end, it has been found that silicates protect cellulose materials at least to some extent, from insects, the destructive effects of fungus, bacteria and the like. These silicate preservatives have been applied to the cellulose material in several ways. Frequently, the silicates were painted on the material to be preserved; the material was immersed in a silicate solution; or the material was enclosed in a pressure vessel and immersed in a hot silicate solution under pressure to enable the silicate to invade the material being preserved and to permeate its cellulose structure.

These processes for applying a silicate, however, were not entirely satisfactory. Painting or immersing the material in a silicate solution resulted in only a superficial coating of preservative that failed to provide not only a durable, long term treatment, but left untreated those insects, fungus and bacteria that were within the material structure at the time of treatment. Pressure treatment also failed to produce a fully acceptable finished product. Thus, a charge of preservative was mixed with water and heated to form a hot solution in a pressure vessel that contained the material to be treated. The hot solution was pressurized and left in contact with the material for a period of time that was determined by the nature of the product and the preservative.

The solution cooled rapidly to ambient temperature, thus decreasing process efficiency. The preservative compound in the solution also became depleted when the preservative penetrated and was absorbed within the material being treated. This preservative depletion was a particularly serious defect because those portions of the material under treatment that were exposed only to the depleted solution were inadequately treated and hence, were essentially unprotected. Frequently, the preservative compound also would settle out of the entraining water, thereby reducing the quantity of preservative available for direct application to the cellulose matter being treated.

Consequently, there is need for a process and apparatus for applying preservatives to cellulose material that establishes a better distribution of preservative throughout the cellose matter being treated and deposits the preservative in a concentration that is high enough to protect the material more completely. That is, in a concentration sufficient to eliminate or at least to arrest cellulose deterioration from insect, fungus, bacteria and other sources.

BRIEF SUMMARY OF THE INVENTION

These and other deficiencies in the prior art are overcome, to a great extent through the practice of the invention. Illustratively, cellulose material, such as stack of railroad ties is placed in a pressure vessel. The loaded pressure vessel is sealed and a vacuum is drawn in the pressure vessel. About the same, a time work tank is filled with a charge of wood preservative and water. The mixture is heated and stirred throughly in the work tank. On reaching the appropriate temperature, a valve is opened and the heated liquid flows into the evacuated pressured vessel. A pump raises the liquid pressure within the pressure vessel to a predetermined level above that of atmospheric pressure whereupon the liquid penetrates the physical structure of each of the ties that comprise the stack. As the preservative is deposited within the structure of each of the ties, the concentration of preservative within the liquid becomes depleted.

Thus, in accordance with a feature of the invention, depleted liquid is pumped from the pressure vessel back to the work tank where it is reheated prior to recirculation from the work tank to the pressure vessel in order to maintain thermal efficiency for the process and, through recirculation, to keep entrained preservative materials in suspension. At the work tank, if the preservative in the liquid is sufficiently depleted, more preservative is mixed with the liquid and as noted above, this mixture, is heated to the process temperature. The heated and replenished liquid then is pumped into the pressure vessel in order to subject the stack of railroad ties to a preservative solution at full potency. The replenishment of preservative and circulation of heated liquid is then carried out continuously in the foregoing manner until the stack of railroad ties has been suitably treated.

This new process produces a treated material that enjoys not only a much more uniform distribution of preservative, but also a higher and therefor more effective concentration of preservative within the cellulose structure than that which characterized prior art treatment processes.

These and other features and advantages of the invention will be more apparent through a study of the following detailed description of an illustrative embodiment of the invention, when taken with the drawing. The breadth of the invention, however, is limited only through the scope of the claims appended hereto.

BRIEF DESCRIPTION OF THE DRAWING

The sole FIGURE of the drawing is a schematic diagram of an illustrative embodiment of the invention.

DETAILED DESCRIPTION

A typical embodiment of the invention is shown in the drawing. For example, a generally cylindrical work tank 10 with a 500 gallon capacity is shown mounted on a base 11. The base 11 also supports a gas, electric or other suitable heater 12. The work tank 10 contains a mixture 13 of water and wood preservative or wood product preservative and, if, desired, a fire retardant. Any environmentally acceptable preservative, it should be noted, that can be dissolved, suspended or otherwise entrained in a liquid is suitable for the purpose of this invention.

Illustrative of the preservatives that can be used with the invention are those described at Pages 3 and 4 of International Application No. PCT/US97/19812 (International Publication No. WO 98/18872, published May 7, 1998).

The work tank 10 is in fluid communication with a conduit 14 through a shut off valve 15. A first "Y" coupling 16 establishes a flow path through a conduit 17 to a fluid pump 20. An outlet 21 from the pump 20, moreover, forms one conduit in a second "Y" coupling 22. Another conduit 23 forms the second branch of the first "Y" coupling 16 through a shut off valve 24. As shown, the conduit 23 proceeds for from the valve 24 to form a second branch of the second "Y" coupling 22. A stem 25 of the second "Y" coupling is selectively interrupted by a shut off value 26. A return conduit 27 also provides fluid communication between the conduit 23 and the work tank 10 through a shut off valve 30.

The stem 25 of the second "Y" coupling 22 provides selective fluid communication with the interior of a 400 gallon pressure vessel 31. The dimensions and volume of the pressure vessel 31 can, of course vary, depending upon the nature of the cellulose product that is to be treated within its confines, e.g. stacks of railroad ties or telephone poles. For the purpose of this illustrative example of the invention, however, the pressure vessel 31 should be proof through a range of pressures that vary from a vacuum of 27 inches of mercury, negative pressure, to a maximum process positive pressure of 250 pounds per square inch (psi) while withstanding a temperature of 180° F. A hatch 32 also is provided on the pressure vessel 31 to permit the insertion and removal of cellulose material that is respectively, to be or has undergone preservation treatment, shown illustratively in the drawing as a stack of railroad ties 34.

A discharge conduit 33 establishes, selectively, either air or fluid communication from the pressure vessel 31 through a pressure relief gate valve 35 to the interior of the work tank 10. In order to draw a negative pressure within the pressure vessel 31, a vacuum pump 36 communicates with the interior of the pressure vessel 31 through a conduit 37 by way of a shut off valve 40 and a portion of the discharge conduit 33.

Further in this respect, it will be noted that the work tank 10 also has a pressure relief vent 41 and a removable filler cap 42 that permits water, preservative and, if desired, fire retardant reagents to be introduced into and mixed within the tank 10. The preservative, fire retardant and water each can be stored in respective storage tanks, not shown in the drawing, and appropriate amounts withdrawn therefrom to bring the concentration in the depleted mixture up to the predetermined level. The concentration of preservative in the water, or other liquid with which it is mixed, is determined through the type preservative used, and the nature of the cellulose material undergoing treatment.

In operation, the hatch 32 is opened and the railroad ties 34 are deposited within the pressure vessel 31, after which the hatch 32 is closed and the filler cap 42 is removed from the work tank 10. A preservative and a suitable quantity of water is introduced into the work tank 10 through the opening provided by removal of the filler cap 42 to provide the mixture 13. After filing the work tank 10 with the mixture 13, the filler cap is replaced and the heater 12 is activated to raise the temperature of the mixture 13 to about 180° F., as measured through a temperature gauge 43 on the work tank 10. While heating the mixture 13, the mixture should be stirred through a suitable agitation means (not shown in the drawing).

The shut off valve 26 is closed to prevent fluid communication between the pressure vessel 31 and the work tank 10. The gate valve 35 is closed, moreover, to block fluid communication between the pressure vessel 31 and the work tank 10 through the discharge conduit 33.

By opening the shut off valve 40 in the conduit 37 a path is provided that enables the energized vacuum pump 36 to evacuate air from the pressure vessel 31 and to discharge that air directly into the atmosphere until an illustrative negative pressure of 27 inches of mercury is drawn within the pressure vessel 31, as registered on vacuum gauge 44. Upon reaching the desired vacuum pressure within the pressure vessel 31, the vacuum pump 36 preferably is continued in operation.

The shut off valves 15 and 26 are opened to establish fluid communication for the heated mixture 13 in the work tank 10 through to the interior of the pressure vessel 31 by way of the conduits 14 and 17 the inactive pressure pump 20 and stem 25. As a result, the mixture 13 flows under suction provided by the vacuum pump from the work tank 10 into the pressure vessel 31 to fill that vessel. Because, in the illustrative embodiment of the invention shown in the drawing, the work tank 10 has a capacity of about one hundred gallons more than the capacity of the pressure vessel 31, the volume of the mixture 13 that remains in the work tank 10 after the pressure vessel 31 is filled is about equal to the sum of this 100 gallon capacity difference, and the volume of fluid within the pressure vessel 31 that is displaced by the stack of railroad ties 34, less the volume of the mixture within the conduits 14, 17, and 23, the stem 25 and the discharge conduit 33.

Upon filling the pressure vessel 31 with the mixture 13 through to a portion of the discharge conduit 33 to the shut off valve 40, the vacuum pump 36 is deactivated and the valve 40 is closed. The pressure pump 20 then is energized to pump the mixture 13 into the pressure vessel 31 with a positive head of pressure until the desired level of 250 psi is reached within the pressure vessel 31. In this circumstance, and in accordance with a feature of the invention, more preservative is added to the mixture remaining in the work tank 10 in order to maintain a reserve of heated and mixed water and preservative at full concentration strength within the work tank 10 for application to the railroad ties 34. Thus, as the heated mixture within the pressure vessel 31 penetrates the cellulose structure of the railroad ties 34, preservative is deposited within portions of the individual ties, leaving only a preservative depleted mixture (with an undesirably low concentration of preservative) to treat the remaining untreated portions of the ties. Consequently, the shut off valve 24 in the conduit 23 is closed and the pressurizing pump 20 is activated to force the freshly prepared, full-strength, heated mixture 13 from the work tank 10 into the pressure vessel 31 and to raise the liquid pressure within the pressure vessel 31 to about 250 psi, as registered on a pressure gauge 45. The pressure relief gate valve 35, moreover, is set to open at fluid pressure above 250 psi. Thus, as the liquid pressure within the pressure vessel exceeds 250 psi, circulation for the mixture 13 is established from the work tank 10 through the pump 20 and the pressure vessel 31 back to the work tank 10 where the recycled mixture is heated once more and a further charge of preservative is stirred into the mixture 13, if needed, in order to bring the mixture up to the desired concentration strength. The concentration of preservative within the mixture 13 can be monitored to determine the preservative strength, (and hence the need for additional preservative in the mixture) by means of probes, and the like.

In this manner, the mixture, at essentially full preservative strength, is continuously circulated throughout the treatment system.

As illustrated in the drawing, it may be useful in certain circumstances to bypass the mixture 13 around the pressure vessel 31. To accomplish this, the shut off valves 24 and 26 are closed and the shut off valve 30 in the return conduit 27 is opened, thereby establishing a fluid path from the work tank 10 through the conduits 14, 17, the pump 20, the outlet 21 ,a portion 46 of the conduit 23 and the return conduit 27, back to the work tank 10.

The charge of railroad ties 34 in the pressure vessel 31 is maintained at temperature and under pressure in the heated mixture 13 that is being recirculated for a length of time determined by the nature of the preservative and the material or species of wood being treated. This continued replenishment of preservative within the mixture 13 and recirculation of a heated mixture produces a significantly improved product in which the preservative distribution and concentration is superior to that provided by prior art methods.

At the end of the treatment process, the mixture 13 is drained from the pressure vessel 31 by reversing the flow of the mixture 13 from the vessel 31 back to the work tank 10 in order to restore the pressure within the pressure vessel 31 to ambient atmospheric pressure.

In the illustrative example, the treated railroad ties 34, after the mixture 13 is drained, are removed from the pressure vessel 31 by opening the hatch 32 and withdrawing the product from the pressure vessel 31 for drying or any other further treatment, as required.

With respect to the step of draining the pressure vessel 31 at the end of the preservative treatment process, it has been found, in accordance with another feature of the invention, preferable to provide a separate pump (not shown in the drawing) to evacuate the mixture from the pressure vessel 31.

As noted above, it may not be necessary or desirable to replenish the wood preservative in the recirculating mixture. In this circumstance it is preferable to maintain the temperature of the mixture at a predetermined level in order to continue the thermal efficiency of the process and to keep in liquid suspension any wood preservative that otherwise might settle out of the mixture. To achieve these goals it is only necessary to reheat the mixture that is circulating back to the work tank and to agitate the heated mixture with the work tank agitator and in the pumps to prevent matter from settling out of the mixture.

Thus there is provided, in accordance with principles of the invention, a significant improvement in preservative and fire retardant treatment of cellulose materials because through the practice of the invention, a better distribution and concentration of the preservative and fire retardant is achieved within the structure of the cellulose material.

What is claimed:

1. A process for treating a charge of cellulose material with a predetermined concentration of preservative and a fluid in a mixture comprising the steps of heating the mixture to about 180° F., placing the charge of cellulose material in a vacuum of at least 27 inches of mercury, applying the mixture to the charge of cellulose material within said vacuum, then subjecting the mixture to a pressure of about 250 pounds per square inch to enable at least some of the preservative in the mixture to be absorbed within the charge of cellulose material, thereby depleting the concentration of the preservative in the mixture, repeatedly replenishing the preservative depleted mixture with more preservative to reestablish approximately the predetermined preservative concentration in the mixture, heating the replenished mixture to about 180° F., agitating the preservative and the fluid, and continuously circulating said replenished mixture under pressure to the same charge of cellulose material that is being treated.

2. A process according to claim 1 further comprising the step of draining the mixture from the charge of cellulose material.

3. A process according to claim 1 wherein the charge of cellulose material comprises a wood product.

* * * * *